United States Patent [19]

Pedracine

[11] Patent Number: 5,048,677

[45] Date of Patent: Sep. 17, 1991

[54] DISPLAY PACKAGE

[75] Inventor: Richard L. Pedracine, Madison, Wis.

[73] Assignee: Rayovac Corporation, Madison, Wis.

[21] Appl. No.: 530,429

[22] Filed: Jun. 1, 1990

Related U.S. Application Data

[63] Continuation of Ser. No. 196,245, May 20, 1988, abandoned.

[51] Int. Cl.[5] ..... B65D 5/50; A47F 7/00

[52] U.S. Cl. ..... 206/45.14; 206/45.31; 206/349; 206/446; 206/493; 211/70.6; 248/152; 248/309.1

[58] Field of Search ..... 206/45.14, 45.15, 45.19, 206/45.31, 320, 349, 446, 477, 476, 487, 486, 488, 490, 493; 211/70.6; 248/152, 309.1, 311.2, 312.1

[56] References Cited

U.S. PATENT DOCUMENTS

| | | | |
|---|---|---|---|
| D. 280,028 | 8/1985 | Petterson | D76/49 |
| 2,442,980 | 6/1948 | Lewis, Jr. | 206/476 X |
| 2,727,620 | 12/1955 | Buttery | 206/45.19 |
| 2,939,622 | 6/1960 | D'Ippolito | 206/45.19 |
| 2,983,368 | 5/1961 | Vander Lugt, Jr. | 206/45.14 |
| 3,338,399 | 8/1967 | Burt | 206/45.33 |
| 3,365,308 | 1/1968 | Janicke | 206/493 X |
| 3,408,758 | 11/1968 | Doring | 206/486 X |
| 3,424,825 | 1/1969 | Marchand | 206/45.19 X |
| 3,627,115 | 12/1971 | Samalon | 206/45.14 |
| 3,631,970 | 1/1972 | Trauschker | 206/45.31 |
| 3,797,648 | 3/1974 | Shaw | 206/493 X |
| 3,874,500 | 4/1975 | Nicholl | 206/45.19 |
| 4,171,050 | 10/1979 | Murray et al. | 206/476 X |
| 4,213,598 | 7/1980 | Halasz | 206/45.14 |
| 4,247,003 | 1/1981 | Jones | 206/486 |
| 4,354,598 | 10/1982 | Schollinger | 206/476 X |
| 4,549,654 | 10/1985 | Tiesman | 206/486 |
| 4,549,656 | 10/1985 | Barnes et al. | 206/443 X |
| 4,753,350 | 6/1988 | Seymour | 206/476 |

FOREIGN PATENT DOCUMENTS

| | | | |
|---|---|---|---|
| 0138416 | 10/1979 | Fed. Rep. of Germany | 206/486 |

*Primary Examiner*—Byron P. Gehman

*Attorney, Agent, or Firm*—Kenyon & Kenyon

[57] ABSTRACT

The present invention relates to a package for a flashlight or similar consumer product that permits a consumer to touch and feel the flashlight without removing it from its secure position within the package. The package comprises a cardboard box arranged in the shape of a "C". The box comprises first and second arms that extend parallel from one side of a support structure to define a display volume between the horizontal arms of the "C". First and second holders are embedded in the first and second arms, respectively, to face each other and hold the flashlight in place. The product is held in the display volume by securing its respective ends to the holders. The package, comprising at least the support structure, the arms and the holders, permits a consumer sufficient access to the product to use his tactile senses to access the product without having to first open the package.

17 Claims, 4 Drawing Sheets

DISPLAY PACKAGE

This application is a continuation of application Ser. No. 07/196,245, filed May 20, 1988 now abandoned.

FIELD OF THE INVENTION

The invention relates to a package for a rugged consumer product, and more particularly to a package for a consumer product, such as a flashlight, that can be more effectively marketed when consumers are permitted to touch the product at the point of sale.

BACKGROUND OF THE INVENTION

Many consumer products, such as flashlights, are specifically designed to be rugged and to withstand abuse. The durability of a product is often a major consideration for the consumer in deciding whether to purchase the product. The best test of durability available to a consumer at the point of sale is often his or her sense of touch. Thus, many consumers want to touch and feel the product before purchasing it.

Additionally, sales to consumers of many consumer products are based on aesthetic appeal. Consequently, a consumer often uses his senses, especially touch and feel to determine whether to purchase a product. A consumer is more apt to purchase a flashlight or other consumer products that he or she can touch.

Conventional packages for consumer goods are often transparent so that a consumer can see the product before he or she buys it. The transparency of the package, however, does nothing to make the product accessible to the consumer. Packages for consumer goods interfere with the consumer's sense of touch by completely enclosing the product. The consumer then has no way to make an independent assessment of the aesthetic feel or durability of the product other than by opening the package. And this is exactly what often happens: a consumer looks at the product, becomes interested in it and opens the package to touch it. The consumer abandons the product in favor of an unopened package of the same product or a package containing a different product. The opened package is never sold and is removed from the display area so as not to detract from the overall aesthetics of the display. The process of opening packaging is then repeated by other consumers so that more products and product displays are wasted. All consumers ultimately pay for the waste in higher prices.

The foregoing problem can be eliminated by allowing consumers to both see and touch the product at the point of sale. One way to allow consumers to touch the product is to sell the product unpackaged. An unpackaged product is typically displayed in a store in a display bin. The display bin, however, is an unacceptable solution for selling a low volume consumer product such as a flashlight, especially when surface blemishes, such as scratches, will prevent the sale of the product. A relatively expensive consumer product such as a flashlight is typically hung on a display rack for sale because display rack facilitates sales by making the product conspicuous and easily accessible to the consumer. Further, the display rack requires less valuable floor space in the store and does not require the store to first unpackage the product.

Another way is to sell a product such as a flashlight in a box that permits partial access to the flashlight. This type of package typically permits access to one or two sides of the flashlight. The consumer can thus tell what the flashlight feels like. The package, however, still obstructs the flashlight. A consumer cannot hold the flashlight in a normal operating position while it is in the package and is thus unable to discern its true "feel".

A need exists for a package for displaying a product such as a flashlight in a display rack in such a way that consumers have full access to the product while it remains securely held in its package.

SUMMARY OF THE INVENTION

The present invention relates to a package for a flashlight or similar consumer product that gives a consumer access to the flashlight without having to remove it from its secure position within the package. The package comprises a cardboard box arranged in the shape of a "C" to form a display volume that is open from three sides. The box comprises first and second arms that extend parallel from one side of a support structure to define a display volume between the horizontal arms of the "C". First and second holding means are embedded in the first and second arms, respectively, to face each other and hold the flashlight in place. The product is held in the display volume by securing its respective ends to the holding means. The package, comprising at least the support structure, the arms and the holding means, permits a consumer to access the product from three sides so that he can use his tactile senses to access the product without having to first open the package. Preferably, the display volume is sufficiently large that the consumer can get his hand completely around the flashlight. Sufficient room can be left between the flashlight and the support structure to accommodate the hand of a consumer.

DETAILED DESCRIPTION OF THE INVENTION

The present invention will be described in terms of a package for a flashlight. It is to be understood that the principles of the present invention also can be applied to the packaging for other consumer products.

Figure 1:
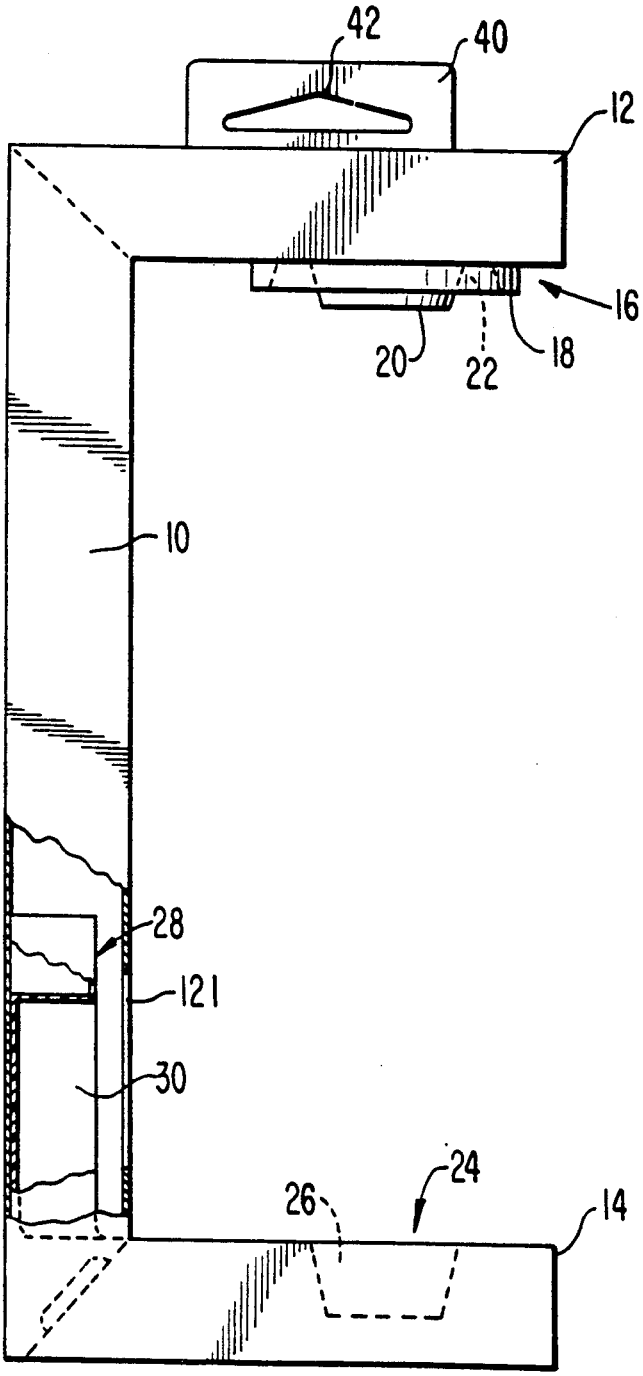
FIGS. 1 and 2 show side and front views, respectively, of a package according to the present invention that is adapted for holding a flashlight.

FIG. 1 shows a flashlight package according to the present invention. Support structure 10 forms the primary support element for the package. First and second arms 12, 14, respectively, extend from the same side of support structure 10. The arms are parallel both with respect to each other and with respect to support structure 10. First and second arms 12, 14 and support structure 10 form a package in the shape of a "C". The arms define a display volume between their respective arms.

A first holding means, generally labeled as 16, is embedded in the first arm 12 to hold the upper end of the flashlight. First holding means 16 comprises an annular outer ring 18 and an inner circular plateau 20 that are separated so as to form an annular trough 22 that corresponds to an annular projection of the flashlight. A suitable flashlight for use with this package is disclosed in U.S. Design Pat. No. 280,028, assigned to the assignee of record and incorporated herein by reference.

A second holding means, generally labeled as 24, is embedded in second support arm 14 as shown in FIG. 1. Second holding means 24 comprises an indentation 26 for securing the end of the flashlight that is opposite the bulb. Second holding means 24 faces first holding means 16 on the inside of the "C" facing the first arm. The first and second holding means are aligned so that the rim at the front of the flashlight fits within annular trough 22 and the end of the flashlight fits inside indentation 26. The first and second holding means thus secure the flashlight between the first and second arms so long as the holding means remain embedded therein.

Figure 2:
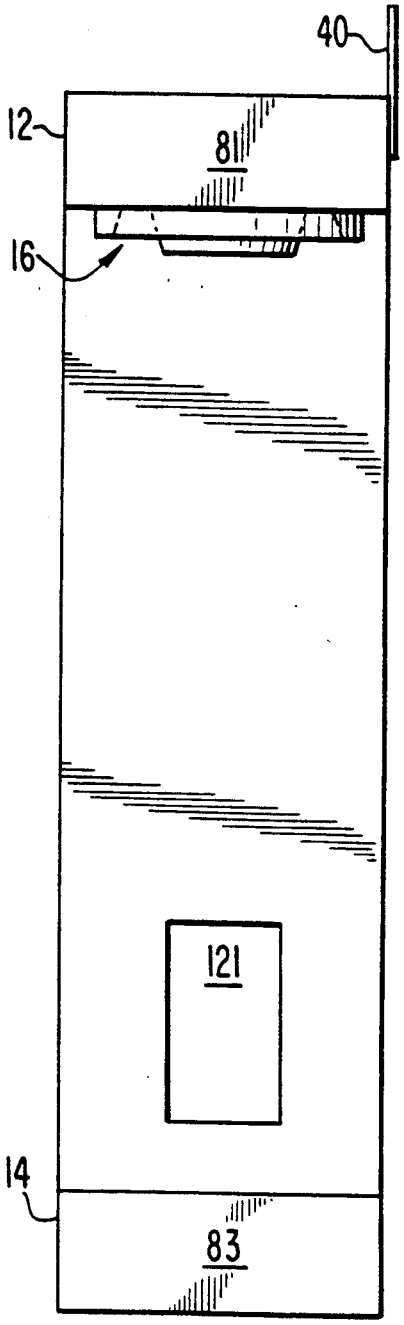

In FIGS. 1 and 2 the first and second arms define a display volume in which the flashlight is securely mounted. It is considered essential to the present invention that the containment volume be open on at least one side so that the consumer can touch the flashlight without having to break open the package. The display volume is preferably sufficiently large that a consumer can hold the flashlight in its normal operating position. This result is most simply accomplished by orienting the flashlight so that its switch extends out of the plane of FIG. 1. FIGS. 1 and 2 show an embodiment of the invention in which the first and second arms 12, 14, extend from support structure 10 without additional interconnecting structure. The display volume is thus open on three sides so that a consumer can reach his or her hand around the flashlight and grab it from the left side in FIG. 1 and the left and right sides as shown in FIG. 2. The consumer can thus hold the flashlight in its ordinary operating position.

The embodiment of the present invention shown in FIGS. 1 and 2 contains an additional battery containment means 28 within support structure 10 for containing batteries within the package. Battery containment means 28 defines a containment area 30 for the batteries. Containment area 30 preferably holds a plurality of batteries so that the anode of one battery does not touch the cathode of the other battery such as by placing the batteries in parallel and oriented perpendicularly to the plane of FIG. 1. It is preferred that the relatively heavy batteries be kept near the bottom of support structure 10, near second arm 14, to give the package a low center of gravity.

The flashlight package according to the present invention preferably further comprises a hang tab 40 having an aperture 42 for accommodating the hook of a display rack. Hang tab 40 should be positioned so that the package hangs vertically when hung by tab 40 in a display case. Aperture 42 therefore should be approximately centered over the center of gravity of the package.

Figure 3:
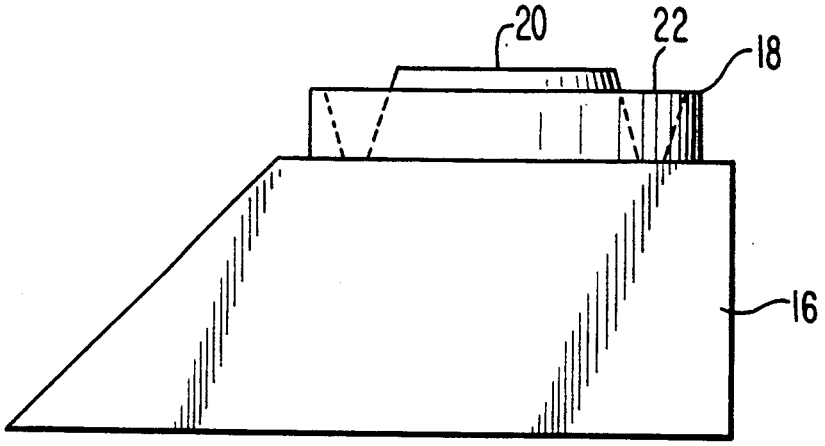
FIGS. 3 and 4 show the first holding means for the first arm of the package shown in FIGS. 1 and 2.
Figure 4:
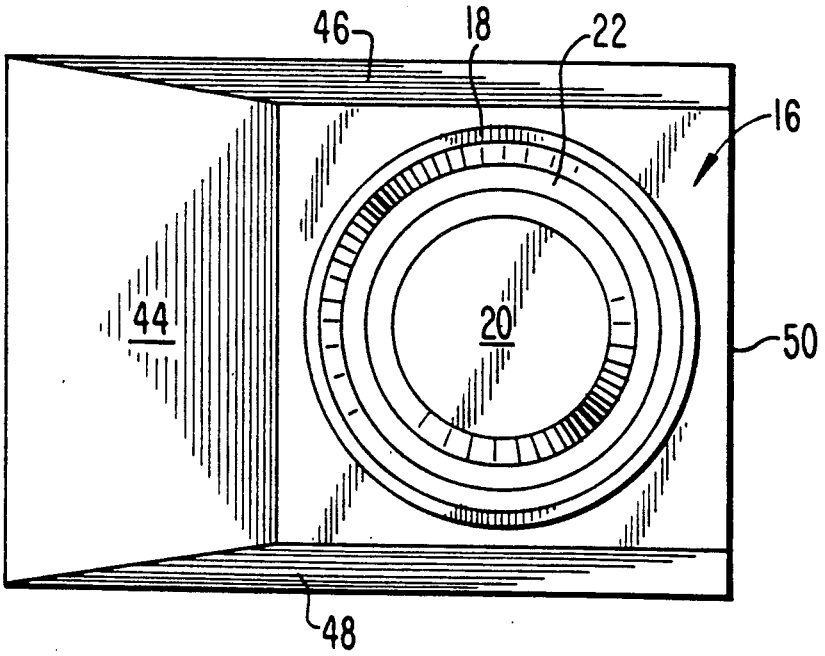

FIG. 3 shows an enlarged view of first holding means 16 shown in FIGS. 1 and 2. It is preferred that the first holding means 16 be made from a clear plastic so that the front of the flashlight, comprising the bulb and reflector, can be seen through the top of the package FIG. 4 shows a top view of the flashlight package shown in FIGS. 1 and 2. Packaging flaps 44, 46, 48 and 50 prevent the first holding means 16 from sliding out from above and grip the outside edges of the first holding means 16 so that it cannot slide out from below. Flap 44 forms an approximately 45° angle with respect to the top of first arm 12. Flaps 46 and 48 form a much steeper angle. Flap 50 is essentially vertical in the view shown in FIG. 4.

Figure 6:
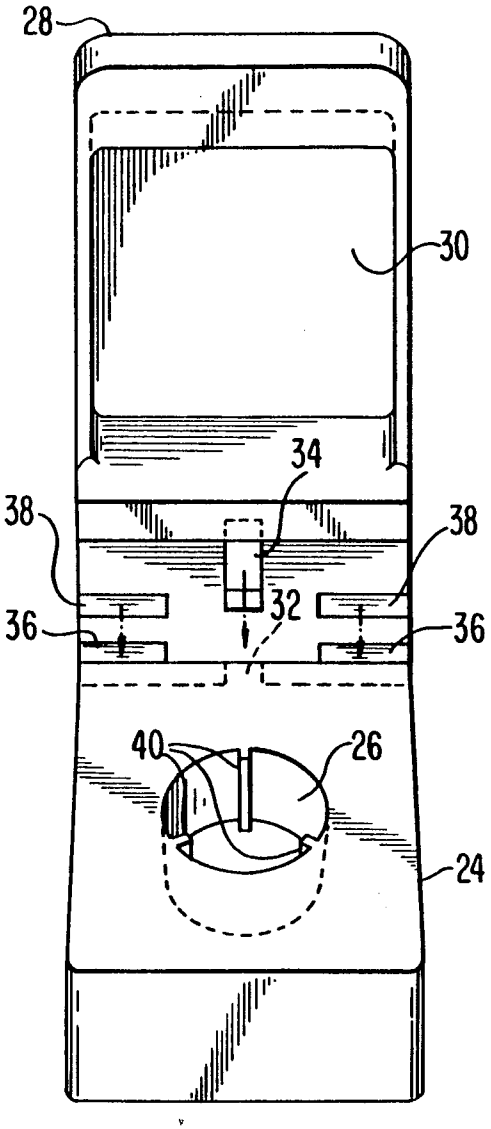
FIGS. 5 and 6 show the second holding means for the second arm of the package shown in FIGS. 1 and 2.
Figure 5:
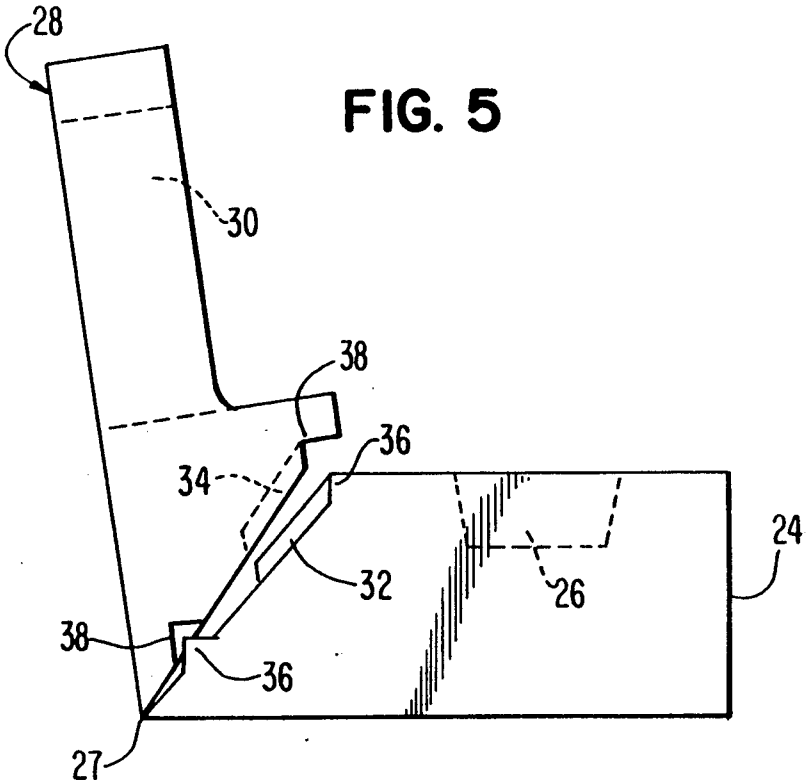

If first support means 16 is made of a clear plastic material, then the consumer can directly view the bulb and reflector of the flashlight from the top. As shown in FIG. 4, flaps 44, 46, 48 and 50 form an aperture through which the reflector of the flashlight is readily visible when viewed through first holding means 16. Alternately, the transparent region could be limited to inner circular plateau 20 or additionally include annular trough 22 and annular ring 18 in order. Alternately, inner circular plateau 20 could be eliminated to provide direct viewing of the front of the flashlight. The aperture formed by flaps 44, 46, 48 and 50 together with the transparent construction of first holding means 16 comprise a means for viewing the front end of the product held by the package FIGS. 5 and 6 show the detail of the construction of the second holding means 24 and battery holding means 28 shown in FIGS. 1 and 2. The second holding means 24 and battery support means 28 are preferably fabricated as a single piece of plastic that is joined at hinge 27 and secured together by a snap formed by elements 32, 34, respectively. Additional ledges 36 and indentations 38 are provided to further secure the pieces together.

FIG. 6 shows indentation 26 as further comprising elements 40. These elements are designed to cooperate with corresponding structures on the flashlight to prevent it from rotating in the package. Similar elements may be provided on first holding means 12 if desired to cooperate with and appropriate structure on the flashlight.

It is preferred that holding means 24 and battery containment means 28 be made from clear plastic. A transparent second holding means permits the consumer to view the bottom most part of the flashlight as mounted. A transparent battery containment means 28 enables the consumer to view batteries in containment area 30 as described below.

Figure 7:
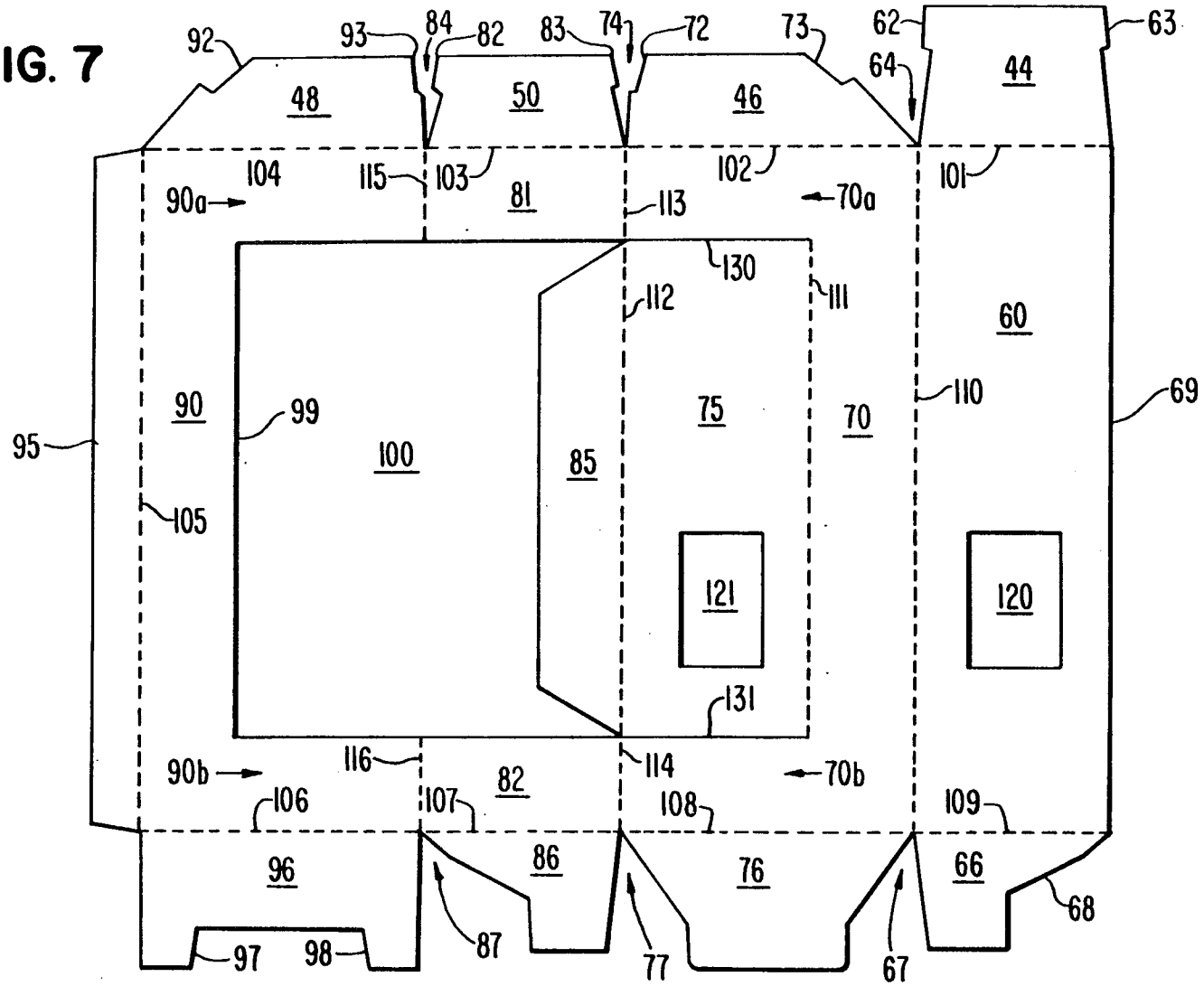
FIG. 7 shows the construction of the box used in the package shown in FIGS. 1 and 2.

FIG. 7 shows the box used to form the package shown in FIGS. 1 and 2. Side 60 forms the back side of support structure 10 which is opposite the display volume. Tab 44 is positioned at the top of the box and folded over fold line 101 to form an inclined surface as shown in FIG. 4. Tab 44 comprises two tabs 62, 63 that fit under tabs 46 and 48 through notch 73 of tab 46 and notch 92 of tab 48 to secure tab 44 in the position shown in FIG. 4.

A groove 64 separates tab 44 from adjoining tab 46. A fold 102 joins tab 46 to element 70 which comprises two arms, **70*a*, 70*b*, that form the arms 12, 14, shown in FIG. 1. Element 70 is joined to element 60 across fold 110. A central tab 75 is formed by slits 130, 131 and connected to element 70 by fold 111. Tab 75 forms the front side of support structure 10** that faces the display volume.

A groove 74 separates tab 46 from tab 50. Tab 83 on tab 50 slides under indentation 72 on tab 46 to help secure tab 50 in the position shown in FIG. 4. A fold 103 joins tab 52 to element 81. Fold 113 connects element 81 to arm **70*a* of element 70 and forms the outside surface of first arm 12 shown in FIG. 2**.

A groove 84 separates tab 50 from tab 48. A tab 82 on tab 50 cooperates with groove 93 on tab 48 to further support tabs 50 and 48 in the positions shown in FIG. 4. A fold 104 connects tab 48 to arm **90*a* of element 90. Element 90 forms one side of support element 10 and arms 12, 14, shown in FIG. 1. A fold 115 connects arm 90*a* of element 90 to element 81** at the top of the package.

Elements 81, 83 and 90 and tab 85 define a display aperture 100. The display aperture and slits 130, 131 permit access to the display volume from three sides when the box is folded into position.

The construction of the bottom of the support package will now be described. A fold 106 connects a tab 96 to the bottom arm 90*b* of element 90 that forms part of second arm 14 shown in FIG. 7. Tab 96 further comprises tabs 97 and 98 which will be described below. Tab 96 forms part of the bottom of the package shown in FIGS. 1 and 2.

A fold 116 connects arm 90*b* of element 90 to element 83. Element 83 forms the front surface of the second arm 14 shown in FIG. 2. A fold 107 connects tab 86 to element 83. A groove 87 separates tab 86 from tab 96 so that tab 86 can extend over tab 98 when the package is assembled.

A fold 114 connects element 83 to arm 70*b* of element 70 to form a part of the second arm 14. A fold 108 connects tab 76 to arm 70*b* of element 70. A groove 77 separates tab 76 from tab 86 so that tab 76 extends over tabs 86 and 98 when the flashlight is assembled. A fold 109 connects a tab 66 to element 60. A groove 67 separates tab 66 from tab 76 so that tab 76 can be folded over tab 66 when the box is assembled. An additional groove 68 permits tab 66 to fold over tab 97 of tab 96 when the box is assembled.

The box is assembled by folding folds 101–116 out of the plane of FIG. 7. The tabs 44, 46, 48, 50, 66, 76, 86, and 96 are inserted with respect to each other as described above. In addition, the box is glued together as follows. A fold 105 attaches first glue tab 95 to element 90. Glue is applied to the reverse side of glue tab 95 as shown in FIG. 7 for form a first glue line. The reverse side of first glue tab 95 is glued onto element 60 inside edge 69 along the first glue line. Additionally, a fold 112 connects second glue tab 85 to tab 75. As shown in FIG. 7, glue is applied to the reverse side of second glue tab 85 which is then attached to element 90 inside edge 99 to form a second glue line. Before the construction of the box for the package according to the present invention is complete, first and second holding means 16, 24 are inserted into the top and bottom of the box, respectively. Support tab 40 is then attached to first arm 12.

Optionally, an aperture 120 can be cut into support element 60 to permit viewing the battery containment means 28 from behind. Aperture 120 thus provides a view of the batteries so long as battery containing means 28 is made from clear plastic. In addition, an aperture 121 can be cut into tab 75 to permit direct access to the batteries from the front of the support element 10.

The principles, embodiments and modes of operation of the present invention have been described in the foregoing specification. The invention which is intended to be protected herein should not, however, be construed as limited to the particular form described as it is illustrative and not restrictive. Variations and changes may be made by those skilled in the art without departing from the spirit of the invention. Accordingly, the foregoing detailed description should be considered exemplary in nature and not as limiting to the scope and spirit of the invention set forth in the appended claims.

What is claimed is:

1. A package for supporting and displaying a product, comprising:

a support member having an inner wall, an outer wall, an upper portion and a lower portion;

a first arm extending from said support member in the vicinity of said upper portion, said first arm including a lower region;

a second arm extending from said support member in the vicinity of said lower portion, said second arm including an upper region;

a raised portion for cooperating with one end of a product, said raised portion extending from the lower region of said first arm toward said second arm, said raised portion including a first projection and a second projection disposed about said first projection, said first and second projections extending toward said second arm and being radially spaced from one another such that they form a trough therebetween for receiving one end of the product;

a recessed portion for receiving another end of the product, said recessed portion being formed in the upper region of said second arm and having a side wall extending toward said first arm;

whereby said raised and recessed portions enable the product to be supported, while being displayed in its substantial entirety between said support member and first and second arms.

2. The package of claim 1, wherein said raised portion includes a substantially circular member.

3. The package of claim 2, wherein said raised portion includes a frustoconical wall that extends from substantially the entire boundary of said substantially circular member.

4. The package of claim 1, wherein said trough is annular.

5. The package of claim 1, wherein said raised portion is transparent.

6. The package of claim 5, wherein said first arm defines an aperture located above said raised portion to provide optical communication therewith.

7. The package of claim 1, wherein said side wall of said recessed portion has projections extending therefrom.

8. The package of claim 7, wherein said side wall of said recessed portion is substantially circular and said projections extend radially inwardly therefrom.

9. The package of claim 1, wherein said recessed portion is transparent.

10. The package of claim 1, wherein said support member includes a chamber formed between said inner and outer walls for holding auxiliary items.

11. The package of claim 10, wherein said chamber is disposed in said lower portion of said support member adjacent to said second arm.

12. The package of claim 11, wherein said inner wall of said support member includes an aperture that provides optical communication with said chamber.

13. The package of claim 12, wherein said outer wall of said support member includes an aperture that provides optical communication with said chamber.

14. A package for supporting and displaying a flashlight, comprising:

a support member having an upper and a lower portion and first and second walls, said second wall having an aperture formed therethrough;

a first arm extending from said support member in the vicinity of said upper portion, said first arm including a lower region;

a second arm extending from said support member in the vicinity of said lower portion, said second arm including an upper region and being substantially parallel to said first arm;

a raised portion for cooperating with one end of a flashlight, said raised portion extending from the lower region of said first arm toward said second arm and having an annular trough formed therein;

a recessed portion for receiving another end of the flashlight, said recessed portion being formed in the upper region of said second arm and having a side wall extending toward said first arm;

a battery containment means disposed between said first and a second walls and having an opening in communication with said aperture in said second wall of said support member.

15. The package of claim 14, wherein said raised portion is annular.

16. The package of claim 14, wherein said recessed portion includes a bottom wall, said side wall surrounds said bottom wall.

17. The package of claim 14, wherein said battery containment means is in the vicinity of the lower portion of said support member adjacent to said second arm.

* * * * *

UNITED STATES PATENT AND TRADEMARK OFFICE

CERTIFICATE OF CORRECTION

PATENT NO. : 5,048,677

DATED : September 17, 1991

INVENTOR(S) : Richard L. Pedracine

It is certified that error appears in the above-identified patent and that said Letters Patent is hereby corrected as shown below:

| Column | Line | |
|---|---|---|
| 4 | 29 | Change "and" to --an--. |
| 4 | 35 | Change "bottom most" to --bottommost--. |
| 5 | 34 | After "FIG. 7" change "for" to --to--. |

Signed and Sealed this

Second Day of March, 1993

*Attest:*

STEPHEN G. KUNIN

*Attesting Officer*

*Acting Commissioner of Patents and Trademarks*